United States Patent [19]

Pittenger

[11] Patent Number: 4,547,118

[45] Date of Patent: Oct. 15, 1985

[54] FRONT END LOADER

[75] Inventor: Francis H. Pittenger, Shelby, Ohio

[73] Assignee: Peabody International Corp., Stanford, Conn.

[21] Appl. No.: 464,780

[22] Filed: Feb. 9, 1983

[51] Int. Cl.[4] ..... B65F 3/04

[52] U.S. Cl. ..... 414/408; 414/685

[58] Field of Search ..... 414/408, 685, 406; 91/464

[56] References Cited

U.S. PATENT DOCUMENTS

| | | | |
|---|---|---|---|
| 2,984,374 | 5/1961 | Herpich et al. | 414/408 |
| 3,011,666 | 12/1961 | Dempster et al. | 414/408 |
| 3,278,059 | 10/1966 | Ridgeway et al. | 414/408 |
| 3,381,587 | 5/1968 | Parquet | 91/464 X |
| 3,662,910 | 5/1972 | Herpich et al. | 414/408 X |
| 4,345,868 | 8/1982 | Rizzo et al. | 414/408 |

FOREIGN PATENT DOCUMENTS

| | | | |
|---|---|---|---|
| 1020376 | 2/1966 | United Kingdom | 414/408 |

*Primary Examiner*—Joseph E. Valenza
*Assistant Examiner*—David A. Bucci
*Attorney, Agent, or Firm*—Fisher, Crampton, Groh & McGuire

[57] ABSTRACT

A front end loader mechanism for a refuse handling vehicle wherein a pair of swingable lift arms have a pair of pivoted fork arms for engaging a refuse container and lifting it to an unloading position, the fork arms being foldable relative to the lift arms when the latter are in a transport position to minimize the overall length of the vehicle and have a cam abutment arrangement establishing the minimum angle to which the fork arms can be moved relative to the lift arms in the unloading position to prevent interference between various components of the loader mechanism, vehicle and refuse container.

6 Claims, 5 Drawing Figures

FRONT END LOADER

This invention relates to refuse handling equipment and more particularly to front loading type lift and dump apparatus for dumping waste materials from containers into refuse collecting vehicles.

Front loading type refuse handling equipment typically has a pair of lift arms connected at opposite sides of the vehicle and a pair of lift forks pivoted to ends of the lift arms to detachably engage refuse containers which are thereafter lifted and dumped into a refuse collecting body on the vehicle. With such equipment it is necessary to limit the dump position of the lift forks relative to the lift arms to prevent engagement of the refuse containers with the body of the vehicle which otherwise might cause damage to either the vehicle body or to the container. The same angular position of the lift forks and lift arms in the lowered and transport position of the lift arms extends the overall length of the vehicle which may impair maneuvering and also may be beyond the legal overall length limits of the vehicle. The protruding forks also are in a position where they may be accidently damaged or cause damage. In addition, although it is customary to maneuver between loading of different refuse containers with the lift arms raised to a partially elevated position, this results in uncontrolled sway during movement of the vehicle and imposes undesirable loads on the pivot bearings supporting the lift arms relative to the vehicle. It is consequently desirable to support the lift arms during movement between loads.

In accordance with the present invention, a front end loading mechanism is provided in which a pair of lift arms are mounted on a vehicle for movement between a lower transport position in which the lift arms are vertically supported to relieve the loads on the lift arms and their pivotal support and the lift forks are retracted to a folded position through an intermediate loading position in which the lift arms are partially elevated and and the lift forks extend horizontally to engage refuse containers and finally to an elevated unloading position at the top of the vehicle in which the angular position of the lift forks relative to the lift arms is limited to prevent engagement of the refuse containers with the vehicle or with the lift arms. In the transport position, the lift forks may be moved to a substantially vertical position to reduce the overall length of the vehicle and to collapse the lift forks into a position where they are not likely to be damaged or to cause damage in maneuvering. In the elevated unloading position a cam means limits the amount of angular movement towards the lift arms to prevent engagement of the refuse containers with the vehicle. The cam means is automatically moved to a first position in the transport position of the lift arms to permit folding of the lift forks, and upon movement of the lift arms toward an elevated position, the cam means are automatically moved into a second position where they will act as stops to limit the angular position of the lift forks relative to the lift arms.

A presently preferred embodiment of the invention is illustrated in the accompanying drawings in which.

Figure 1:
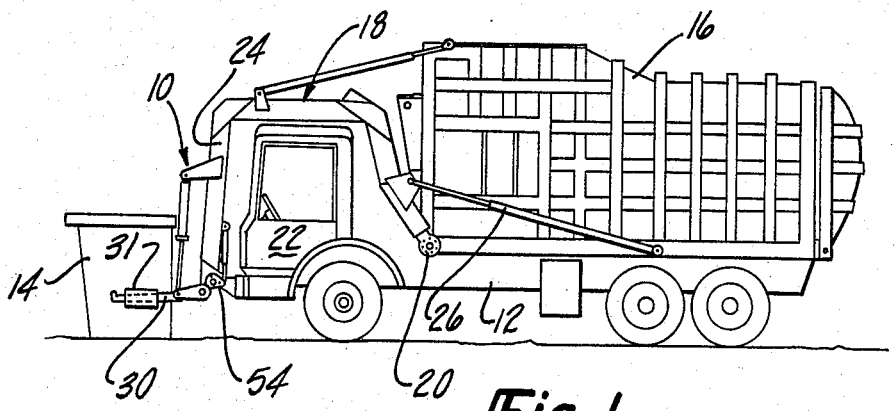
FIG. 1 is a side elevation of the refuse collecting vehicle equipped with a front end loader mechanism embodying the invention.

The front end of loader mechanism embodying the invention is designated generally at 10 and is shown in association with a truck 12 used to collect trash or refuse. The front end loader mechanism 10 is adapted to engage and pick up refuse containers 14 and to lift the containers to an elevated position where the container 14 is pivoted to empty its contents by gravity into a refuse collecting body 16 forming part of the truck 12.

The front end loader mechanism 10 includes a pair of generally U-shaped lift arms 18 pivoted at 20 rearwardly of the cab 22 of the truck 12. The lift arms 18 extend upwardly from the pivots 20 and then forwardly with one leg 24 depending downwardly at the front of the cab 22 when the lift arms are in their lowered or transport position. The lift arms 18 are provided with hydraulic cylinders 26 which are actuated to swing the lift arms 18 vertically relative to the vehicle 12 between the transport position illustrated in FIGS. 1 and 2, through an intermediate position illustrated in FIG. 3, to an unloading position illustrated in FIG. 4 and back to the initial transport position.

The free ends of the lift arms 18 are provided with fork arms 30 which are adapted to engage in sockets 31 typically formed at opposite ends of refuse containers 14 to temporarily connect the containers to the front end loader mechanism 10.

Figure 2:
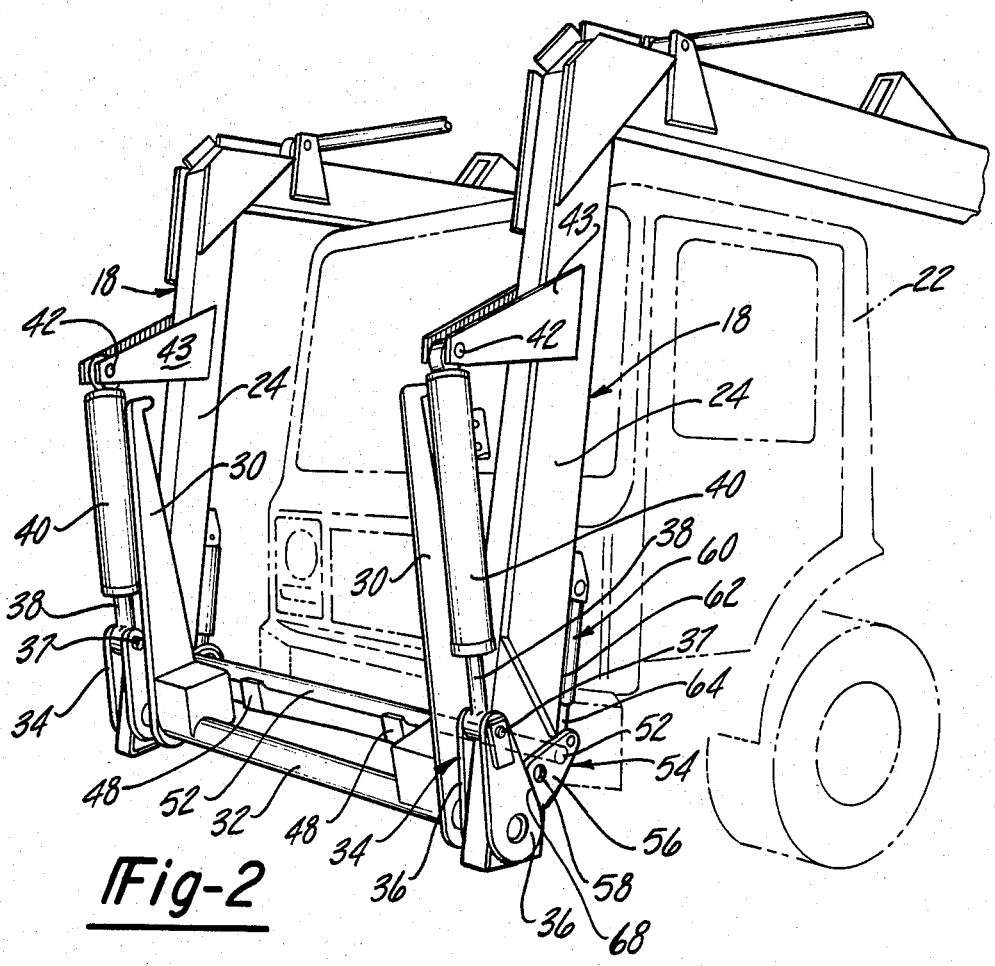
FIG. 2 is an enlarged perspective view showing the front portion of the vehicle with the loader mechanism in its transport position.

The fork arms 30 are rigidly connected to opposite end portions of a transverse shaft 32 as best seen in FIG. 2, which is rotatably supported in the free ends of each of the lift arms 18 so that the fork arms 30 can swing in unison. A crank arm assembly 34 is connected at opposite ends of the shaft 32 and each assembly 34 includes a pair of crank arms 36 at opposite sides of the lower end of each lift arm 18. The free ends of the crank arms are pivotally connected by pins 37 to the free end of a piston rod 38 forming part of a hydraulic actuator 40. The ends of the hydraulic actuator opposite the rod ends are pivotally connected at 42 to brackets 43 rigidly formed with the leg 24 of each of the lift arms 18. The hydraulic actuators are connected to well known hydraulic conduits and controls by which an operator in cab 22 can cause the hydraulic actuator 40 to be actuated to extend or contract the piston rod 38 and pivot the fork arms 30 about the axis of the shaft 32 relative to the lift arms 18.

In the transport position of the front end loader mechanism 10, the weight of the loader mechanism is supported at the pivots 20 and also at the front end of the vehicle 12 by means of support hooks 48 connected at opposite sides at the forward ends of the body of the vehicle 12. The upper surfaces of the hooks 48 are provided with grooves 50 (FIG. 3) which receive a support bar or shaft 52 connected to lift arms 18 through cam assemblies 54 rigidly connected to opposite ends of the support shaft 52. The cam assemblies 54 each include a pair of cam plates 56 disposed at opposite sides of the associated lift arm 18 and are joined together for pivotal movement as a unit relative to the associated lift arm 18 about pivots 58. The support shaft 52 has each of its opposite ends connected to the cam plates 56 at a point radially spaced from the axis of the pivot 58. As a result, when the lift arms 18 are lowered to their transport position, for example, from the position seen in FIG. 3 to the position seen in FIG. 2, the support shaft 52 seats in the grooves 50 of the support hooks 48 on the front of the vehicle 12 and causes the cam assemblies 54 to pivot about the axis of pivots 58. In the transport position additional pivoting movement of the cam assemblies 54 in a counterclockwise direction is prevented by engagement of the support shaft 52 with the rear edges of the lift arms 18.

During pivoting movement of the cam assemblies 54 in a counterclockwise direction about pivots 58, a spring cylinder 60 is compressed. The spring cylinder includes a cylinder body 62 which contains a spring (not seen) and a rod 64. Opposite ends of the spring act against the rod and the spring cylinder to be compressed by the pivotal action of the cam assemblies 54. As a result in the transport position of the front end loader mechanism 10 as viewed in FIG. 2, the forward portion of the lift arms 18 and the associated fork arms 30 are vertically supported by engagement of the support hooks 48 and the support shaft 52 and the spring cylinder 60 is under a loaded condition.

When the lift arms 18 are moved to their transport position, the cam assemblies 54 are pivoted in a counterclockwise direction about the pivots 58 due to engagement of the support shaft 52 with the support hooks 48 to compress the spring cylinder 60. This resiliently cushions the movement of the lift arms 18 to the transport position, and in the engaged position, support shaft 52 and support hooks 48 support the vertical weight of the front end loader mechanism 10 to prevent swaying or twisting of the front end loader 10 during maneuvering of the vehicle 12 between pick-ups of a different refuse container 14. In the supported condition, the fork arms 30 are capable of movement to a substantially vertical position in which they are at a minimum angle relative to or in line with the lift arms 18.

When the vehicle 12 equipped with the front end loader mechanism 10 is maneuvered into position relative to a refuse container 14, the hydraulic cylinders 40 can be actuated to swing the fork arms 30 away from the lift arms 18 which in turn are elevated slightly to release the support shaft 52 from the support hooks 48. At the same time, the fork arms are pivoted a remaining distance to a substantially horizontal position in alignment with the complementary connectors or sockets 31 on the refuse container 14. Subsequent maneuvering of the vehicle 12 relative to the container 14 causes engagement and a temporary attachment of the refuse container 14 to the fork arms 30. Thereafter, further elevation of the lift arms 18 is accomplished by retraction of the hydraulic actuators 26 and controls can be manually operated to maintain the fork arms 30 and refuse container 14 in a substantially horizontal position.

Figure 3:
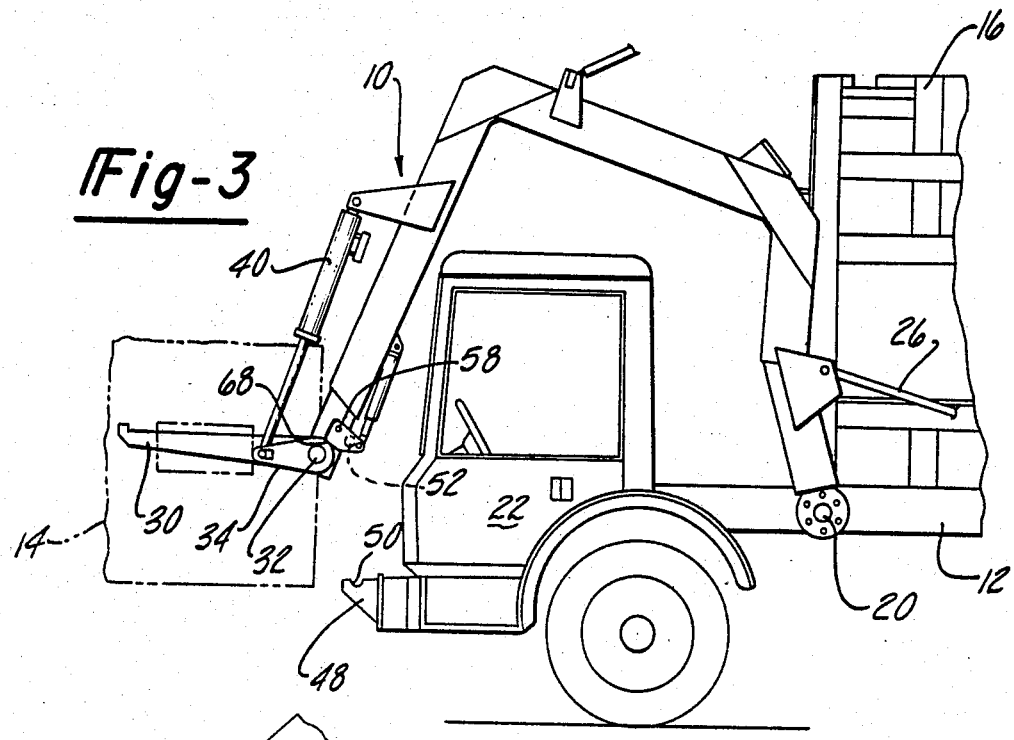
FIG. 3 is a side elevation of a front portion of the vehicle showing the loader mechanism in an intermediate position picking up a refuse container.

Upon initial upward pivotal movement of the lift arms 18, the support shaft 52 is free of the support hooks 48 and the spring cylinder 60 acts to automatically swing the cam assemblies 54 in a clockwise direction to the position seen in FIG. 3. This permits pivotal movement of the crank arm assemblies 34 and the fork arms 30 relative to the lift arms 18.

Figure 4:
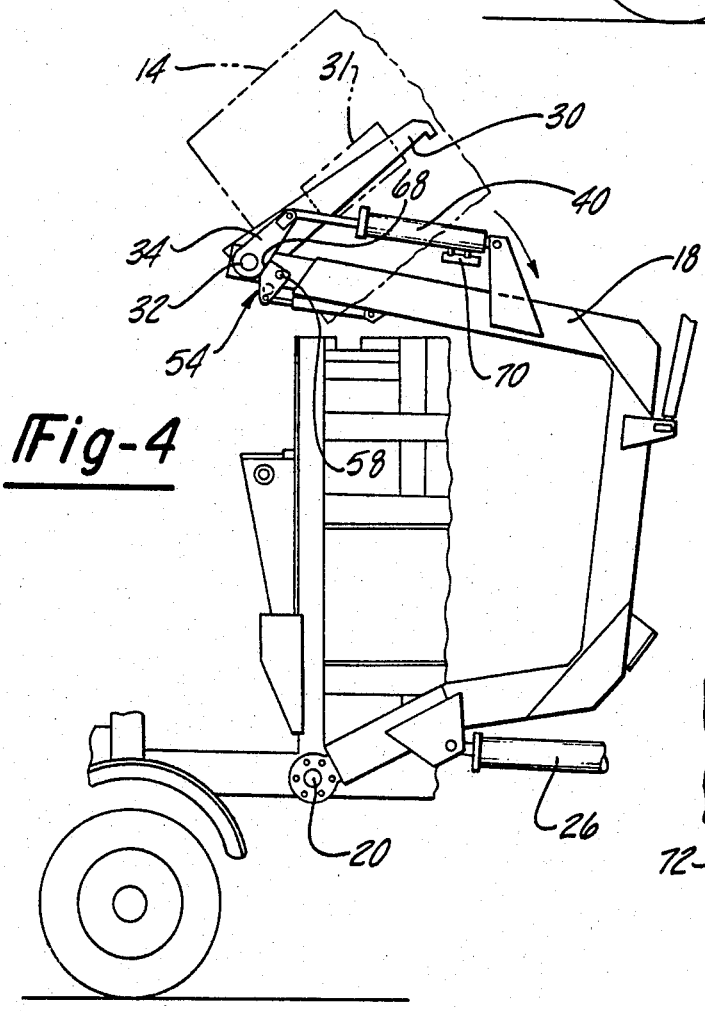
FIG. 4 is a view showing the lift forks in a dumping position relative to the lift arms of the front end loader mechanism.

When the lift arms 18 reach their fully elevated or unloading position as seen in FIG. 4, the second or new position of the cam assemblies 54 causes interference with the crank arm assemblies 34 so that the angle that the fork arms 30 can assume during the dumping of the refuse container is limited. This limitation of the angular position prevents the refuse container 14 from engaging the refuse storage body 16 which could cause damage to it or to the fork arms 30.

Figure 5:
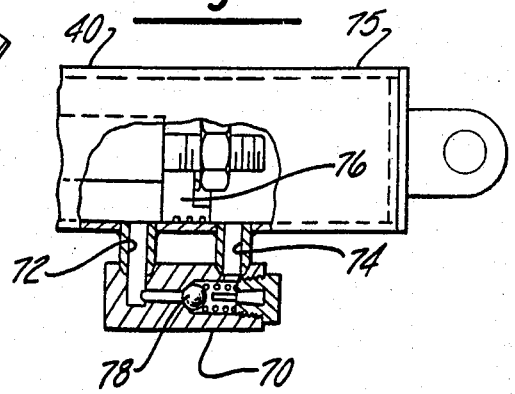
FIG. 5 is an enlarged cross-sectional view of a bypass valve seen in FIG. 4.

When the fork arms 30 reach the unloading position seen in FIG. 4 the cam assemblies 54 will have a stop face 68 engaged by the crank arm assemblies 34 to limit further movement and at the same time further hydraulic pressure is relieved from the hydraulic cylinder 40. As seen in FIG. 5 this is achieved by a bypass valve assembly 70 communicating through passages 72 and 74 with the interior of the cylinder 75 at opposite sides of the piston 76. Communication between the passages 72 and 74 is controlled by a spring loaded check valve 78. As a consequence when the fork arms 30 reach their unloading position relative to the lift arms 18 as seen in FIG. 4, further movement of the fork arms 30 is resisted by the cam assemblies 54. This temporarily increases the pressure at the rod side of the piston 76 causing unseating of the check valve 78 and allowing fluid flow to the opposite side of the piston 76. This relieves the pressure on the various component when the fork arms 30 reach their unloading position without requiring any further or special attention by the operator.

After the refuse container 14 is unloaded into the vehicle body 16, fork arms 30 are pivoted in a return direction followed by counterclockwise pivoting of lift arms 18 as the lift arms approach a lowered position illustrated in FIG. 2, the support shaft 52 engages the support hooks 48 and rotation of the cam assemblies 54 is resiliently resisted to cushion the seating of the shaft 52 in the support hooks 48. At the same time the cam assemblies 54 are rotated in a counterclockwise direction about the pivots 58 to a position which permits movement of the fork arms 30 to a folded or retracted position substantially parallel to the hydraulic lift cylinders 40. In that position the fork arms 30 are retracted to a transport position which reduces the overall length of the vehicle 12 and protects the fork arms against damage. Also the vertical weight of the front end loader 10 is supported thereby preventing uncontrolled swaying and loading of the pivots 20 and associated components to avoid premature wear or possible damage.

A front end loader mechanism has been provided in which the angle of the fork arms relative to lift arms is limited to prevent interference and engagement of the lifted refuse container relative to other components of the front end load and the vehicle when the front end loader is in its unloading condition but in the transport position the position of the fork arms is not similarly limited and they can be folded into compact and close relationship to the lift arms to limit the overall length of the vehicle.

The embodiments of the invention in which an exclusive property or privilege is claimed are defined as follows:

1. A front end loader mechanism for a motor vehicle comprising: a pair of lift arms pivotally mounted on the vehicle, means for swinging said lift arms about said pivot from a lower transport position at the front of said vehicle through an intermediate loading position and to an elevated unloading position at the top of said vehicle, a pair of fork arms mounted on said lift arms, means for swinging said fork arms between first and second fork arm positions which are substantially a horizontal and a vertical position relative to said lift arms when the latter are in said lower transport position, and cam means on said lift arms movable relative thereto and relative to said fork arms, and actuator means for moving said cam means from a first cam position when said lift arms in said transport position to permit swinging movement of said fork arms from said first fork arm position to said second vertical transport fork arm position, said actuator means moving said cam means to a second cam position permitting swinging movement of said fork arms relative to said lift arms upon movement of the latter from said transport position toward said unloading position, said cam means being in said second cam position to limit the angular position of said fork arms relative to said lift arms by abutment of a stop surface on said cam means with the means for swinging said fork arms to a dumping position between said first and second positions when the latter are in said elevated unloading position.

2. The front end loader mechanism of claim 1 wherein said cam means are pivoted to said lift arms for movement independently of said fork arms and are spaced from said fork arms when said cam means are in said first cam position, and said stop surface is engageable with said means for swinging said fork arms when said cam means are in said second cam position.

3. The front end loader mechanism of claim 1 and further comprising support means on said vehicle, complementary support means on said loader engageable with the support means on said vehicle to support vertical loads of said lift arms when the latter are in said transport position.

4. The front end loader mechanism of claim 3 wherein said support means on said loader are connected to said cam means movably mounted on said lift arms, said support means on said loader being engageable with said support means on said vehicle to move said cam means to said first cam position upon movement of said lift arms to said transport position.

5. The front end loader mechanism of claim 4 wherein said actuator means resists movement of said cam means to said first cam position upon movement of said lift arms to a transport position and being operative to move said cam means to a second cam position in response to movement of said lift arms from said transport position.

6. A front end loader mechanism for a motor vehicle comprising: a pair of lift arms pivotally mounted on the vehicle, means for swinging said lift arms about said pivot from a lower transport position at the front of said vehicle through an intermediate loading position and to an elevated unloading position at the top of said vehicle, a pair of fork arms mounted on said lift arms, means for swinging said fork arms between a horizontal and a vertical position relative to said lift arms when the latter are in said lower transport position, cam means on said lift arms movable relative thereto and relative to said fork arms from a first cam position when said lift arms are in said transport position to permit swinging movement of said fork arms to a vertical transport position and movable to a second cam position permitting swinging movement of said fork arms relative to said lift arms upon movement of the latter from said transport position toward said unloading positions, said cam means being in said second cam position to limit the angular position of said fork arms relative to said lift arms when the latter are in said elevated unloading position by abutment of a stop surface on said cam with the means for swinging said fork arms, support means on said vehicle, complementary support means on said loader engageable with the support means on said vehicle to support vertical loads of said lift arms when the latter are in said transport position, said support means on said loader are connected to said cam means movably mounted on said lift arms, said support means on said loader being engageable with said support means on said vehicle to move said cam means to said first cam position upon movement of said lift arms to said transport position, a spring acting between said cam means and said lift arms, resisting movement of said cam means to said first position upon movement of said lift arms to a transport position thereby providing a cushioning effect and being operative to move said cam means to a said second cam position in response to movement of said lift arms from said transport position.

* * * * *